US010525301B2

(12) United States Patent
Hsu

(10) Patent No.: US 10,525,301 B2
(45) Date of Patent: Jan. 7, 2020

(54) EXPANDABLE EXERCISE SYSTEM

(71) Applicant: GREAT FITNESS INDUSTRIAL CO., LTD., Tainan (TW)

(72) Inventor: Chih-Yung Hsu, Tainan (TW)

(73) Assignee: Great Fitness Industrial Co., Ltd., Tainan (TW)

( * ) Notice: Subject to any disclaimer, the term of this patent is extended or adjusted under 35 U.S.C. 154(b) by 137 days.

(21) Appl. No.: 15/834,317

(22) Filed: Dec. 7, 2017

(65) Prior Publication Data

US 2019/0175980 A1 Jun. 13, 2019

(51) Int. Cl.

| | |
|---|---|
| ***A63B 21/00*** | (2006.01) |
| ***A63B 21/008*** | (2006.01) |
| ***A63B 23/12*** | (2006.01) |
| ***A63B 7/04*** | (2006.01) |

(52) U.S. Cl.

CPC ..... *A63B 21/156* (2013.01); *A63B 7/045* (2013.01); *A63B 21/00069* (2013.01); *A63B 21/0088* (2013.01); *A63B 21/4035* (2015.10); *A63B 23/1209* (2013.01); *A63B 23/1218* (2013.01); *A63B 2225/09* (2013.01); *A63B 2225/102* (2013.01)

(58) Field of Classification Search

CPC ..... A63B 21/156; A63B 21/4035; A63B 21/0088; A63B 7/045; A63B 21/00069; A63B 23/1218; A63B 23/1209; A63B 2225/102; A63B 2225/09; A63B 7/04–045

See application file for complete search history.

(56) References Cited

U.S. PATENT DOCUMENTS

| | | | | | |
|---|---|---|---|---|---|
| 3,599,974 | A * | 8/1971 | Price | A63B 21/015 | 482/118 |
| 3,782,718 | A * | 1/1974 | Saylor | A63B 7/04 | 482/37 |
| 4,625,962 | A * | 12/1986 | Street | A63B 21/015 | 482/116 |
| 5,316,535 | A * | 5/1994 | Bradbury | A63B 23/1209 | 482/114 |
| 5,484,360 | A * | 1/1996 | Haber | A63B 7/04 | 482/37 |
| 5,496,234 | A * | 3/1996 | Sussich | A63B 7/04 | 482/114 |
| 5,951,449 | A * | 9/1999 | Oppriecht | A63B 21/0087 | 482/103 |
| 6,261,208 | B1 | 7/2001 | Carson, Jr. | | |

(Continued)

FOREIGN PATENT DOCUMENTS

| | | |
|---|---|---|
| TW | 201204428 A | 2/2012 |
| TW | 201628676 A | 8/2016 |

*Primary Examiner* — Andrew S Lo

(74) *Attorney, Agent, or Firm* — Rosenberg, Klein & Lee

(57) ABSTRACT

An expandable exercise system is used for mounting a part of an ancillary exercise device. The expandable exercise system includes a main exercise device and another part of the ancillary exercise device. The main exercise device includes a coupling seat. The other part of the ancillary exercise device is pre-mounted to the coupling seat and detachably connected with the part of the ancillary exercise device to form the ancillary exercise device, thereby easily increasing or decreasing the number of training modules to enhance the convenience of product use.

9 Claims, 17 Drawing Sheets

(56) References Cited

U.S. PATENT DOCUMENTS 6,685,607 B1 * 2/2004 Olson ..... A63B 21/00072 482/142
7,018,323 B1 * 3/2006 Reynolds ..... A63B 7/04 482/112
7,303,506 B1 * 12/2007 Reynolds ..... A63B 7/04 482/112
7,775,949 B2 * 8/2010 Bowser ..... A63B 21/00043 482/121
8,523,743 B1 * 9/2013 Miles ..... A63B 21/002 482/103
9,636,539 B1 * 5/2017 Brumit ..... A61H 1/0214
10,010,745 B1 * 7/2018 Brumit ..... A61H 1/0214
10,016,645 B1 * 7/2018 Reynolds ..... A63B 7/045
10,279,212 B2 * 5/2019 Dalebout ..... A63B 21/225
2004/0014568 A1 * 1/2004 Williams ..... A63B 7/04 482/37
2004/0204294 A2 * 10/2004 Wilkinson ..... A63B 21/015 482/54
2005/0148437 A1 * 7/2005 Ryan ..... A63B 21/018 482/37
2006/0035755 A1 * 2/2006 Dalebout ..... A63B 21/00072 482/52
2007/0270287 A1 * 11/2007 McDonnell ..... A63B 21/00 482/72
2007/0275829 A1 * 11/2007 Popescu ..... A63B 7/045 482/37
2008/0234109 A1 * 9/2008 Taylor ..... A63B 21/00 482/51
2008/0248929 A1 * 10/2008 Webber ..... A63B 21/0615 482/96
2009/0137370 A1 * 5/2009 Kushnir ..... A63B 21/00069 482/120
2010/0041520 A1 * 2/2010 Popescu ..... A63B 21/015 482/37
2010/0081550 A1 * 4/2010 Anderson ..... A63B 7/04 482/37
2010/0255959 A1 * 10/2010 Dalebout ..... A63B 21/00072 482/52
2011/0111923 A1 * 5/2011 Bacanovic ..... A63B 22/0605 482/8
2015/0165272 A1 * 6/2015 Bird ..... A63B 21/0058 482/5
2015/0182780 A1 * 7/2015 Olson ..... A63B 21/156 482/139
2017/0361153 A1 * 12/2017 Machovina ..... A63B 22/0076
2018/0140887 A1 * 5/2018 Huppee ..... A63B 21/0618
2018/0154205 A1 * 6/2018 Watterson ..... A63B 71/0622
2018/0214729 A1 * 8/2018 Rubin ..... A63B 21/0058
2018/0221706 A1 * 8/2018 Wu ..... A63B 22/0046

* cited by examiner

EXPANDABLE EXERCISE SYSTEM

FIELD OF THE INVENTION

The present invention relates to an exercise apparatus, and more particularly, to an expandable exercise system for expanding other exercise devices.

BACKGROUND OF THE INVENTION

Most of conventional exercise apparatuses are unchangeable. After the purchase, it is not easy for the consumers to change the number and type of training modules.

Taking the traction training device an example, the related patents include Taiwan Patent Publication No. 1551330 titled "pull-up fitness exercise device", Taiwan Patent Publication No. 201204428 titled "pulling and lifting body building device", etc. These traction training devices mainly include a counterweight assembly on a framework and a traction assembly composed of a pulley and a rope between stretching assemblies. The components can only be used for traction training. In addition, a rope climbing exercise apparatus can only be used for rope climbing training. The related patent includes U.S. Pat. No. 6,261,208 titled "rope pulling frictional exercise device".

As known from the above patents, an exercise device only provides a specific training module. Although some exercise devices have more diverse training modules, but they cannot be arbitrarily increased or decreased according to the demand. For consumers or manufacturers, it is required to take more time and cost to modify or re-purchase other equipment in order to meet the demand. The use is quite inconvenient.

SUMMARY OF THE INVENTION

The primary object of the present invention is to provide an expandable exercise system to enhance the flexibility of product use. The expandable exercise system is used for mounting a part of an ancillary exercise device. The expandable exercise system comprises a main exercise device and another part of the ancillary exercise device. The main exercise device comprises a coupling seat. The other part of the ancillary exercise device is pre-mounted to the coupling seat and detachably connected with the part of the ancillary exercise device to form the ancillary exercise device.

Preferably, the main exercise device is a traction exercise device. The ancillary exercise device is a rope climbing exercise device. The other part of the ancillary exercise device is a transmission mechanism.

Preferably, the main exercise device includes a pair of first traction handles, a first pull rope, and a load device. The first pull rope is connected with the pair of first traction handles and the load device. The load device includes a wheel body and a resistance unit. The wheel body is rotatably mounted to the coupling seat. The resistance unit includes a plurality of blades annually disposed on the wheel body or/and a reluctance unit for providing wind resistance and reluctance.

Preferably, the load device further includes a resistance adjustment module for adjusting a reluctance value of the reluctance unit.

Preferably, the main exercise device further includes a pair of handle seats and a pair of angle adjustment members. The first traction handles are mounted to the handle seats, respectively. The pair of handle seats are movably connected to the coupling seat. The angle adjustment members are used for fixing the handle seats relative to the coupling seat.

According to another aspect of the present invention, an expandable exercise system is provided. The expandable exercise system comprises a main exercise device and an ancillary exercise device. The main exercise device comprises a coupling seat and a load device. The ancillary exercise device comprises two parts. One of the two parts is a transmission mechanism. The transmission mechanism is mounted to the coupling seat and connected with the load device. The other of the two parts is an operating mechanism detachably connected to the transmission mechanism. The main exercise device and the ancillary exercise device share the same load device.

Preferably, the load device includes a wheel body, a resistance unit, and a resistance adjustment module. The wheel body is rotatably mounted to the coupling seat. The resistance unit includes a plurality of blades annually disposed on the wheel body and a reluctance unit for providing wind resistance and reluctance. The resistance adjustment module is used for adjusting a reluctance value of the reluctance unit.

Preferably, the main exercise device is a traction exercise device. The traction exercise device includes a pair of first traction handles mounted to the coupling seat and a first pull rope. The first pull rope is connected with the pair of first traction handles and the load device so that the pair of first traction handles drive the load device through the first pull rope. The ancillary exercise device is a rope climbing exercise device.

Preferably, the traction exercise device further includes a pair of handle seats and a pair of angle adjustment members. The first traction handles are mounted to the handle seats, respectively. The pair of handle seats are movably connected to the coupling seat. The angle adjustment members are used for fixing the handle seats relative to the coupling seat.

Preferably, the transmission mechanism of the rope climbing exercise device includes a first transmission gear and a transmission assembly. The first transmission gear is pivotally connected to the coupling seat. The transmission assembly connects the first transmission gear and the load device. The operating mechanism of the rope climbing exercise device includes a mounting seat, a climbing rope, a first driven wheel, a transmission belt, a second driven wheel, and a second transmission gear. The mounting seat is detachably mounted to the coupling seat. The climbing rope is wound around the first driven wheel. The first driven wheel and the second driven wheel are pivotally connected to the mounting seat. The transmission belt is wound around the first driven wheel and the second driven wheel. The second transmission gear is connected to the second driven wheel. The second transmission gear is meshed with the first transmission gear.

According to the above technical features, the present invention can achieve the following effects:

1. The coupling seat of the main exercise device is pre-mounted with the part of the ancillary exercise device. Thereby, users and manufacturers can easily expand the exercise device afterwards to enhance the flexibility of product use.

2. The pre-installed part of the ancillary exercise device may be the transmission mechanism which is more inconvenient to be assembled, so that users and manufacturers can easily expand the exercise device afterwards.

3. The main exercise device and the ancillary exercise device can share the same load device to simplify the required components so as to reduce the product cost.

4. The main exercise device and the ancillary exercise device may be a traction exercise device and a rope climbing exercise device, but not limited thereto.

5. When the main exercise device is a traction exercise device, the traction handles can be adjusted by the angle adjustment members for the users to adjust the required angle according to their needs.

6. When the ancillary exercise device is the rope climbing exercise device, the transmission mechanism can be driven by a gear in cooperation with a chain. The disassembly is more convenient.

7. The load device may use wind resistance and/or reluctance. Compared with a conventional weight-loaded load device, the load device of the present invention is light in weight and easy to carry and move.

DETAILED DESCRIPTION OF THE PREFERRED EMBODIMENTS

Embodiments of the present invention will now be described, by way of example only, with reference to the accompanying drawings.

Figure 1:
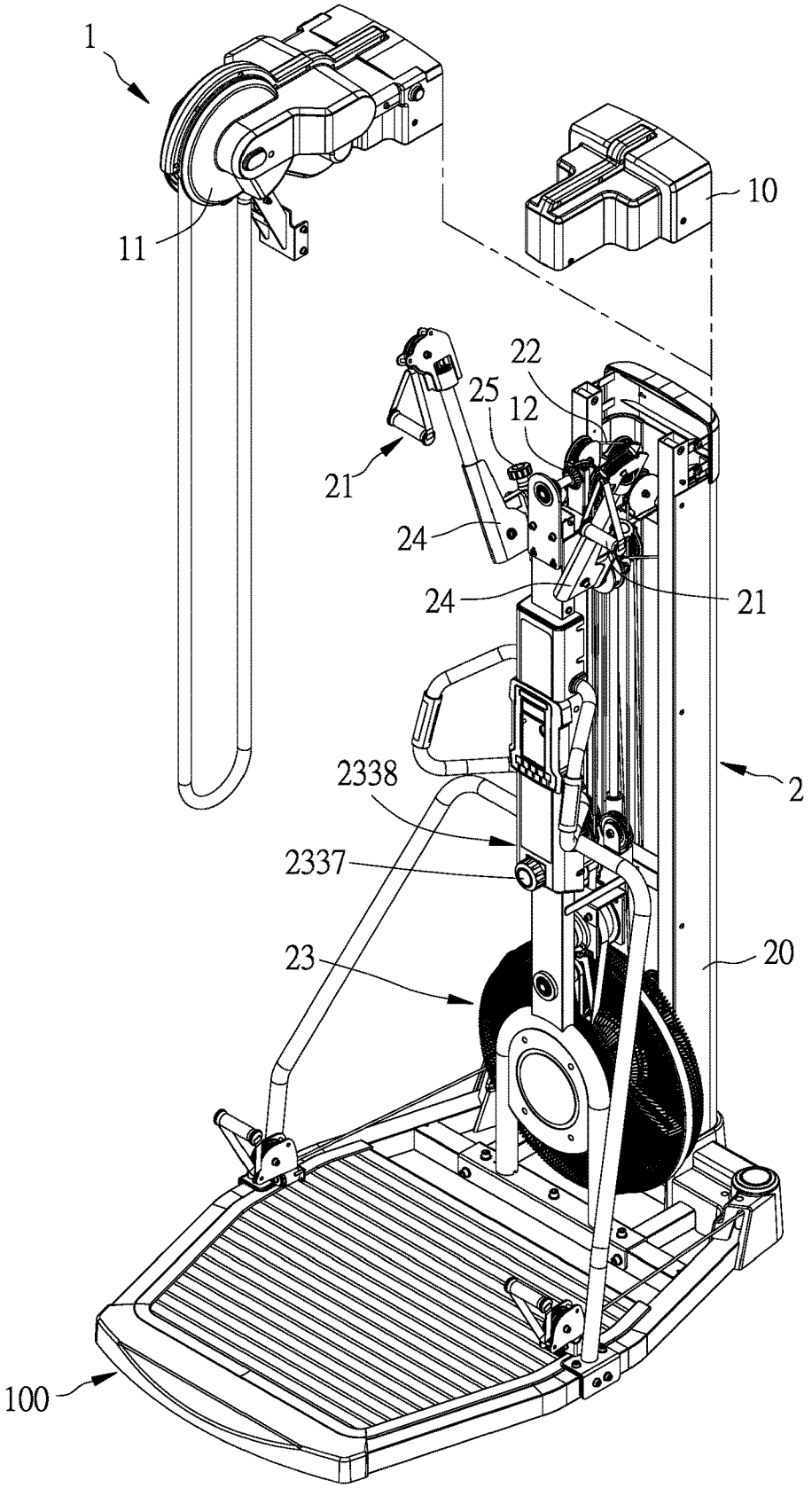
FIG. 1 is an exploded view in accordance with a preferred embodiment of the present invention.
Figure 2:
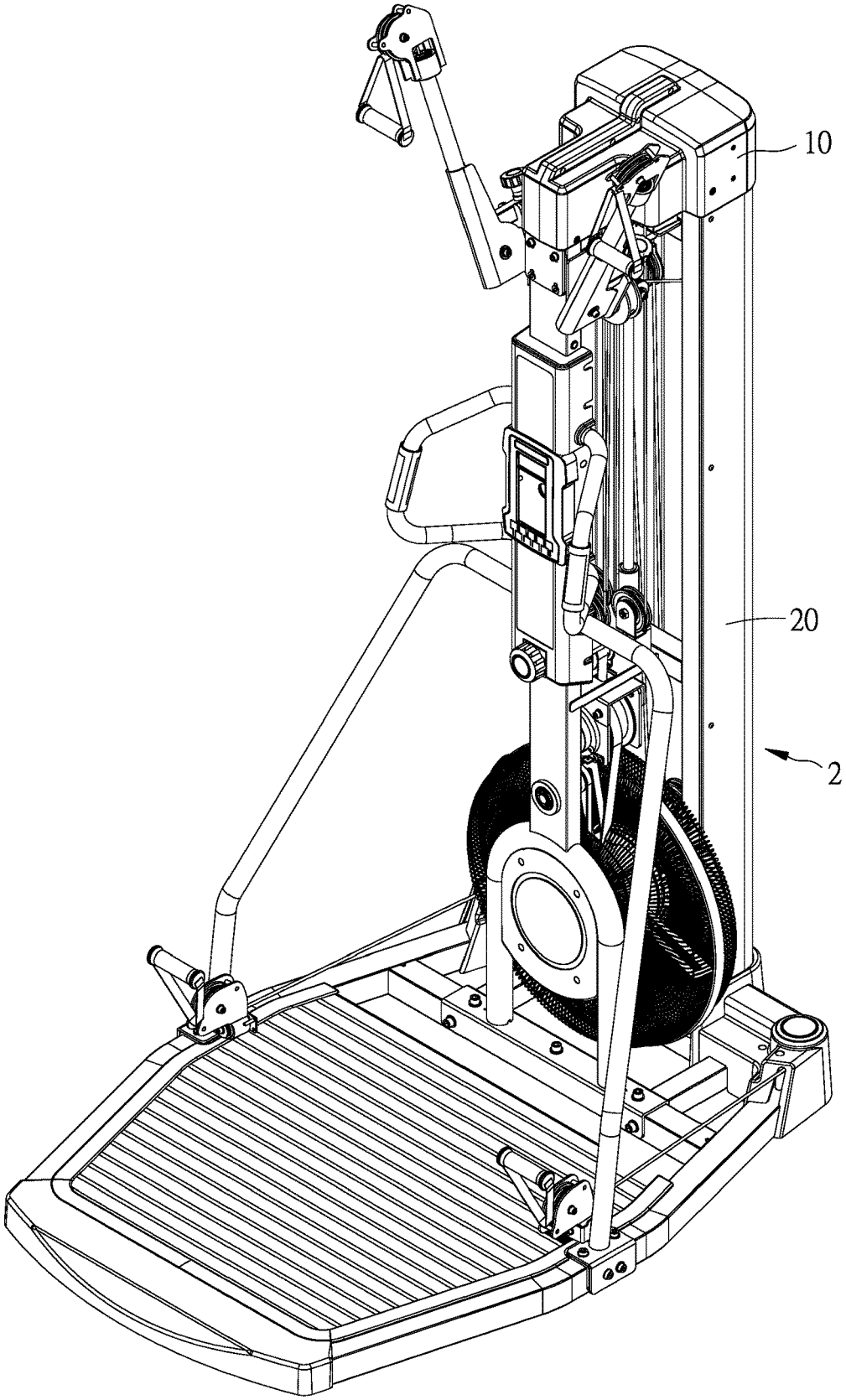
FIG. 2 is a perspective view in accordance with the preferred embodiment of the present invention, wherein the ancillary exercise device is not completely installed.
Figure 3:
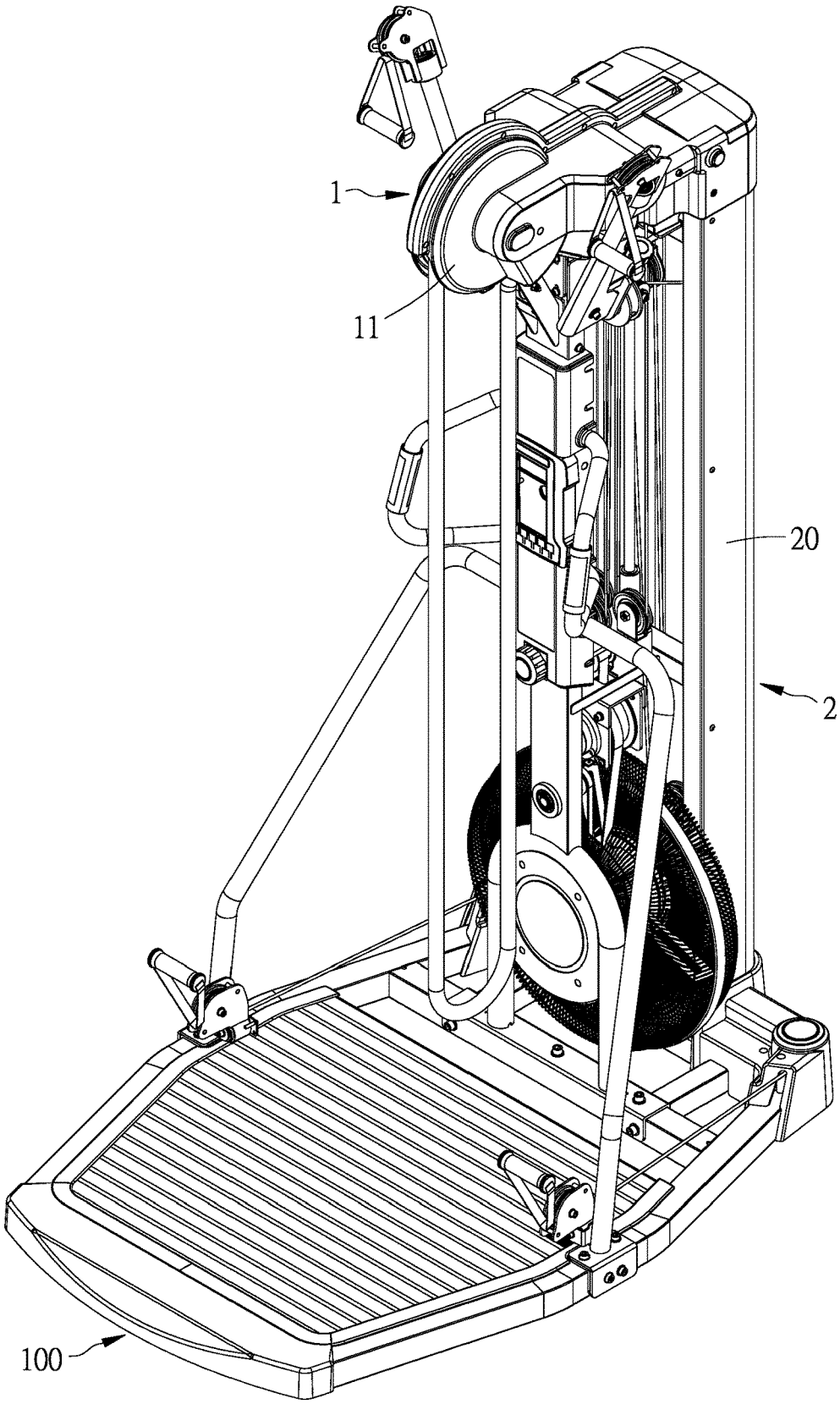
FIG. 3 is a perspective view in accordance with the preferred embodiment of the present invention, wherein the ancillary exercise device is completely installed.

Referring to FIG. 1 and FIG. 2, an expandable exercise system (100) according to an embodiment of the present invention is used for mounting a part of an ancillary exercise device (1). The ancillary exercise device (1) may be a rope climbing exercise device. For example, the part of the ancillary exercise device (1) is an operating mechanism (11). The expandable exercise system (100) may be covered with a cover (10) without the operating mechanism (11). Referring to FIG. 1 and FIG. 3, the expandable exercise system (100) includes a main exercise device (2) and another part of the ancillary exercise device (1). The main exercise device (2) may be a traction exercise device in this embodiment. The main exercise device (2) comprises a coupling seat (20). The other part of the ancillary exercise device (1) is pre-mounted to the coupling seat (20). For example, the other part of the ancillary exercise device (1) is a transmission mechanism (12), which is detachably connected with the operating mechanism (11) of the ancillary exercise device (1) to form the ancillary exercise device (1). Thereby, users and manufacturers can easily expand the exercise device afterwards to enhance the flexibility of product use.

Figure 4:
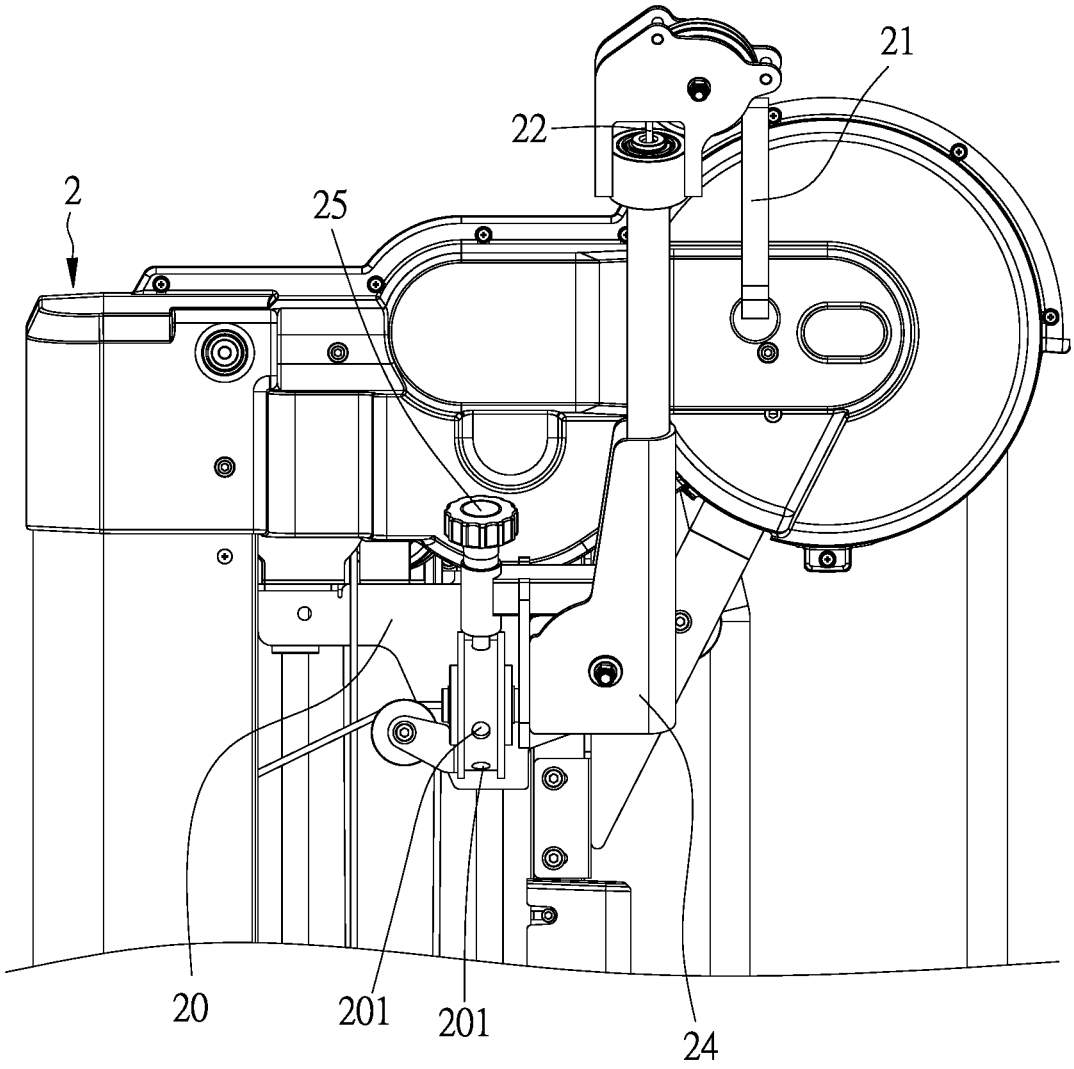
FIG. 4 is a side and partial enlarged view in accordance with the preferred embodiment of the present invention, wherein the ancillary exercise device is completely installed.
Figure 5:
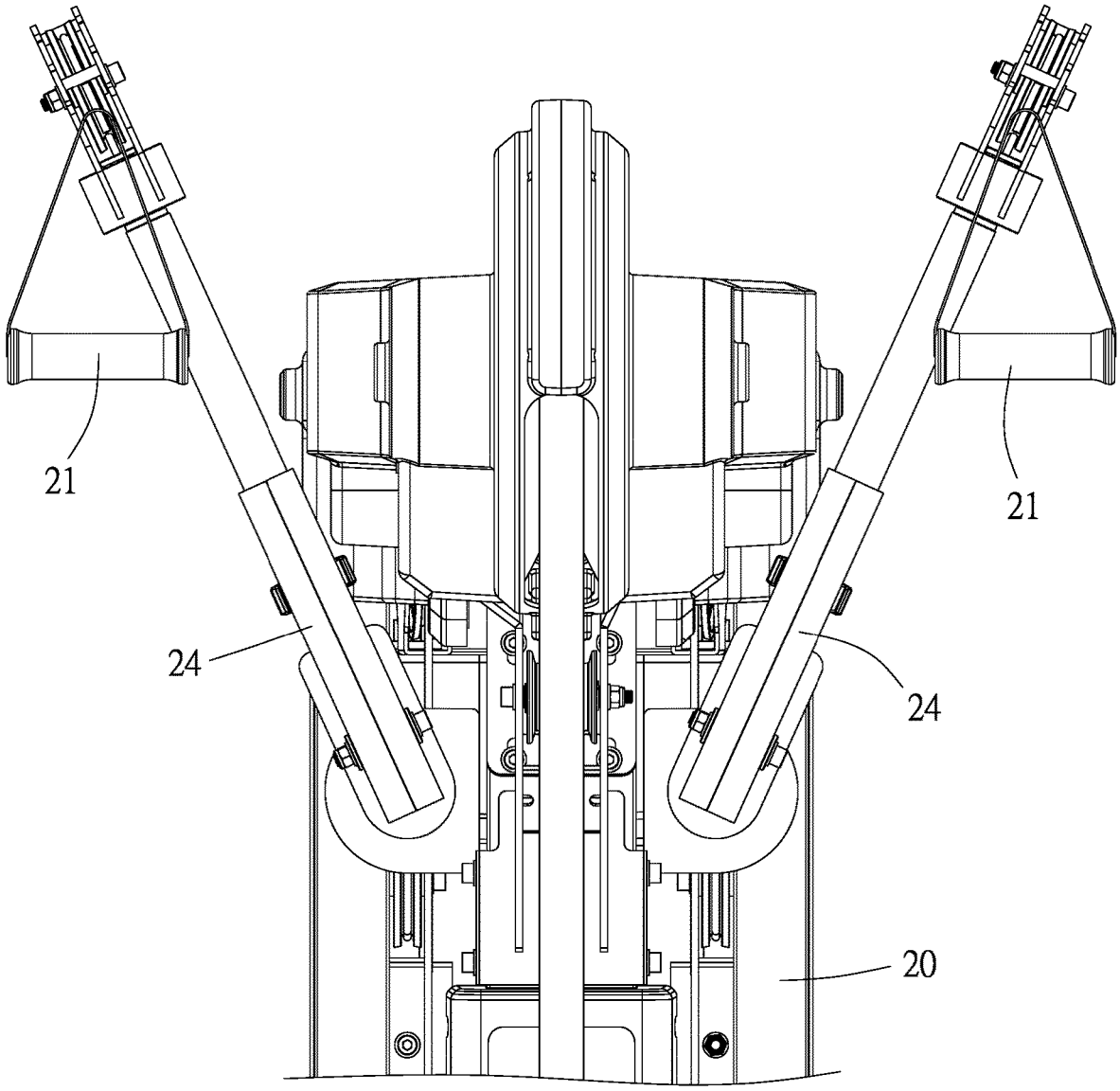
FIG. 5 is a first front and partial enlarged view in accordance with the preferred embodiment of the present invention, wherein the ancillary exercise device is completely installed.
Figure 6:
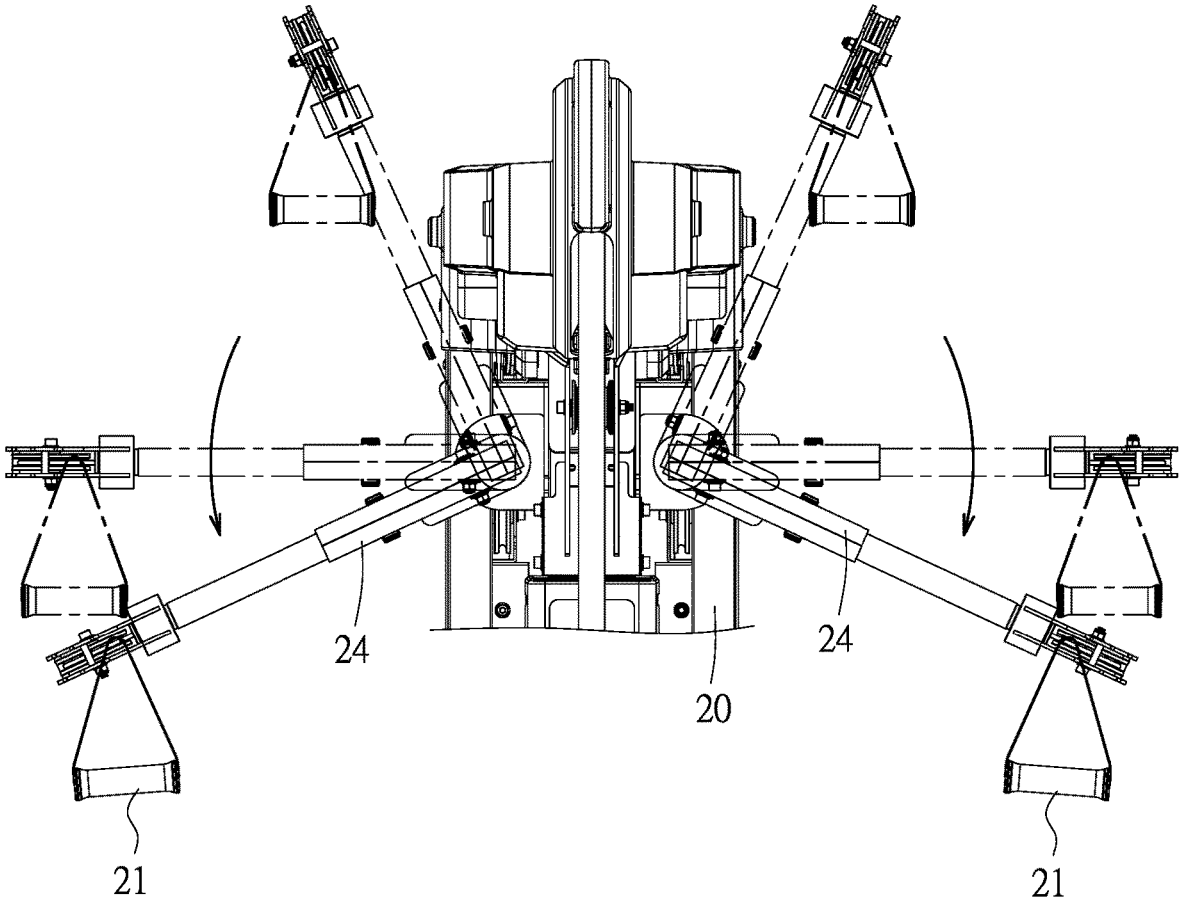
FIG. 6 is a second front and partial enlarged view in accordance with the preferred embodiment of the present invention, wherein the ancillary exercise device is completely installed.

As shown in FIG. 1, the main exercise device (2) includes a pair of first traction handles (21), a first pull rope (22), and a load device (23). The first pull rope (22) is connected with the pair of first traction handles (21) and the load device (23) for the pair of first traction handles (21) to link the load device (23) through the first pull rope (22). Preferably, in this embodiment, the main exercise device (2) further includes a pair of handle seats (24) and a pair of angle adjustment members (25). The pair of handle seats (24) are movably connected to the coupling seat (20). The first traction handles (21) are mounted to the handle seats (24), respectively. The angle adjustment members (25) are used for fixing the handle seats (24) relative to the coupling seat (20). Referring to FIG. 1 and FIG. 4, in detail, the pair of handle seats (24) are pivotally connected to the coupling seat (20). The coupling seat (20) is provided with a plurality of positioning holes (201) in the vicinity of the pair of handle seats (24). The angle adjustment members (25) are movably connected to the handle seats (24) and inserted in one of the positioning holes (201), respectively. When the angle adjustment members (25) are disengaged from the positioning hole (201), as shown in FIG. 5 and FIG. 6, the pair of first traction handles (21) can be relatively turned through the pair of handle seats (24) relative to the coupling seat (20) for the users to adjust the required operating angle according to their needs.

Figure 7:
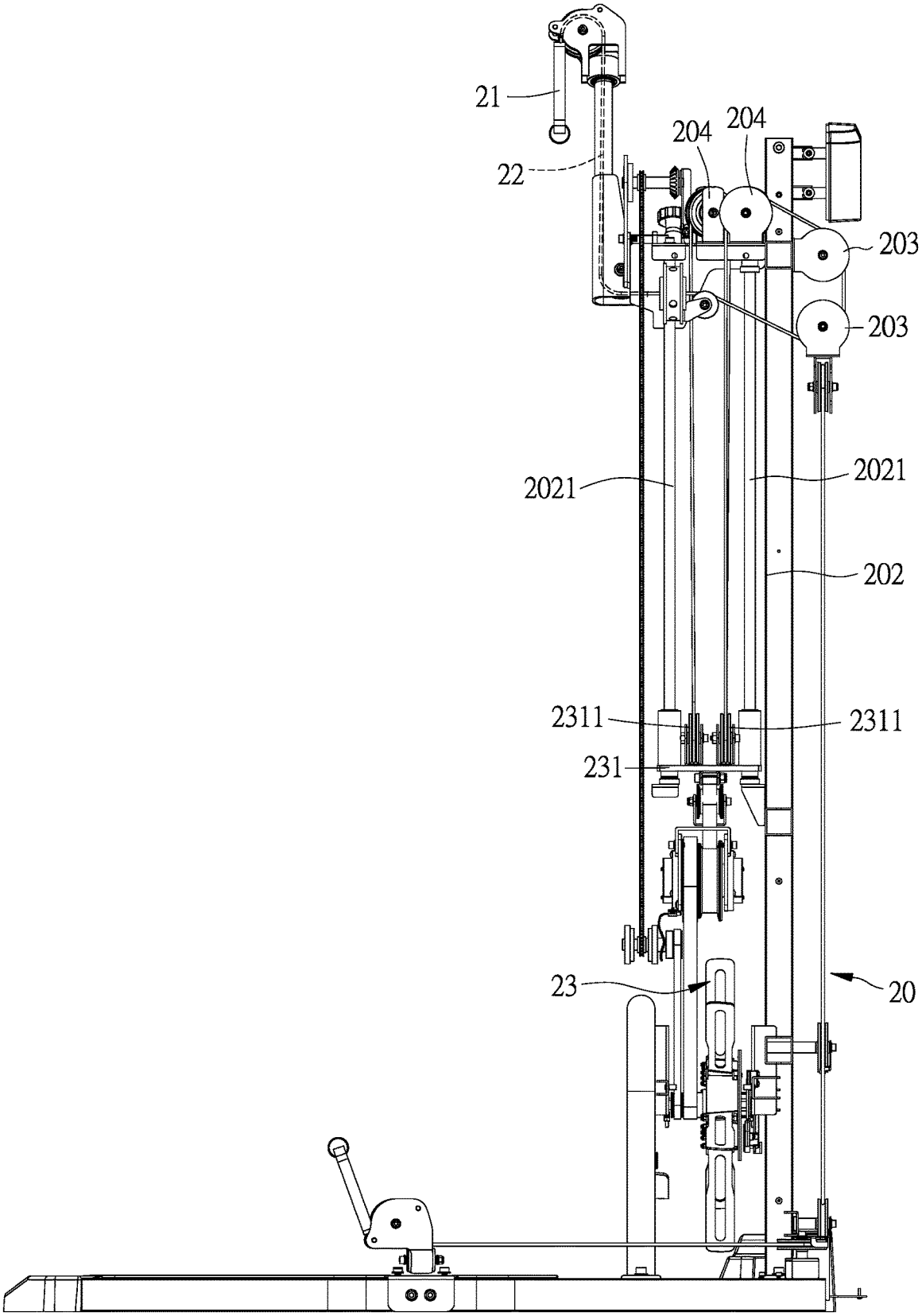
FIG. 7 is a side view of the partial ancillary exercise device in accordance with the preferred embodiment of the present invention without the outer housing.
Figure 8:
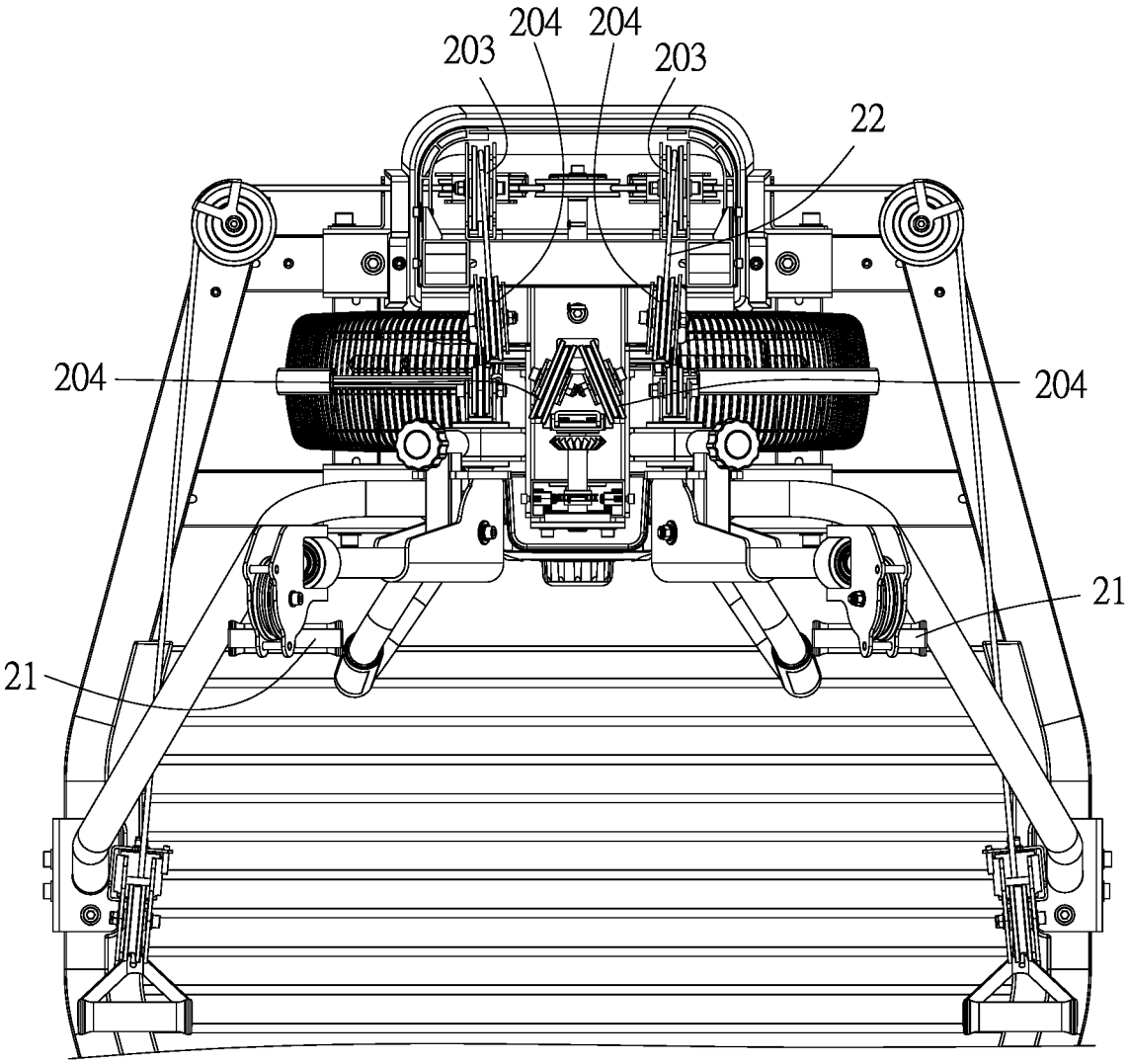
FIG. 8 is a top view of the partial ancillary exercise device in accordance with the preferred embodiment of the present invention without the outer housing.

Referring to FIG. 7 and FIG. 8, the connection relationship between the coupling seat (20), the first traction handles (21), the first pull rope (22) and the load device (23) is further described hereinafter. The coupling seat (20) includes a hollow support post (202) thereon. The support post (202) is provided with a plurality of first guide winding members (203) and a plurality of first support winding members (204) thereon. The first guide winding members (203) are disposed on the circumference of the support post (202). The first support winding members (204) are substantially disposed at the center of the top of the support post (202). The load device (23) is mounted at the center of the bottom of the support post (202). The load device (23) includes a displacement seat (231) which is horizontally mounted to a plurality of guide rods (2021) of the support post 202 and can be substantially vertically displaced. The displacement seat (231) is provided with a plurality of second support winding members (2311) thereon. One end of the first pull rope (22) is connected to one of the first traction handles (21), and then the first pull rope (22) is sequentially wound around the first guide winding members (203), the first support winding members (204) and the second support winding members (2311), and the other end of the first pull rope (22) is connected to the other of the first traction handles (21). Thereby, when the first traction handles (21) are pulled, the displacement seat (231) of the load device (23) can be linked to move a load member (such as a resistance wheel) to provide a training load.

Figure 9:
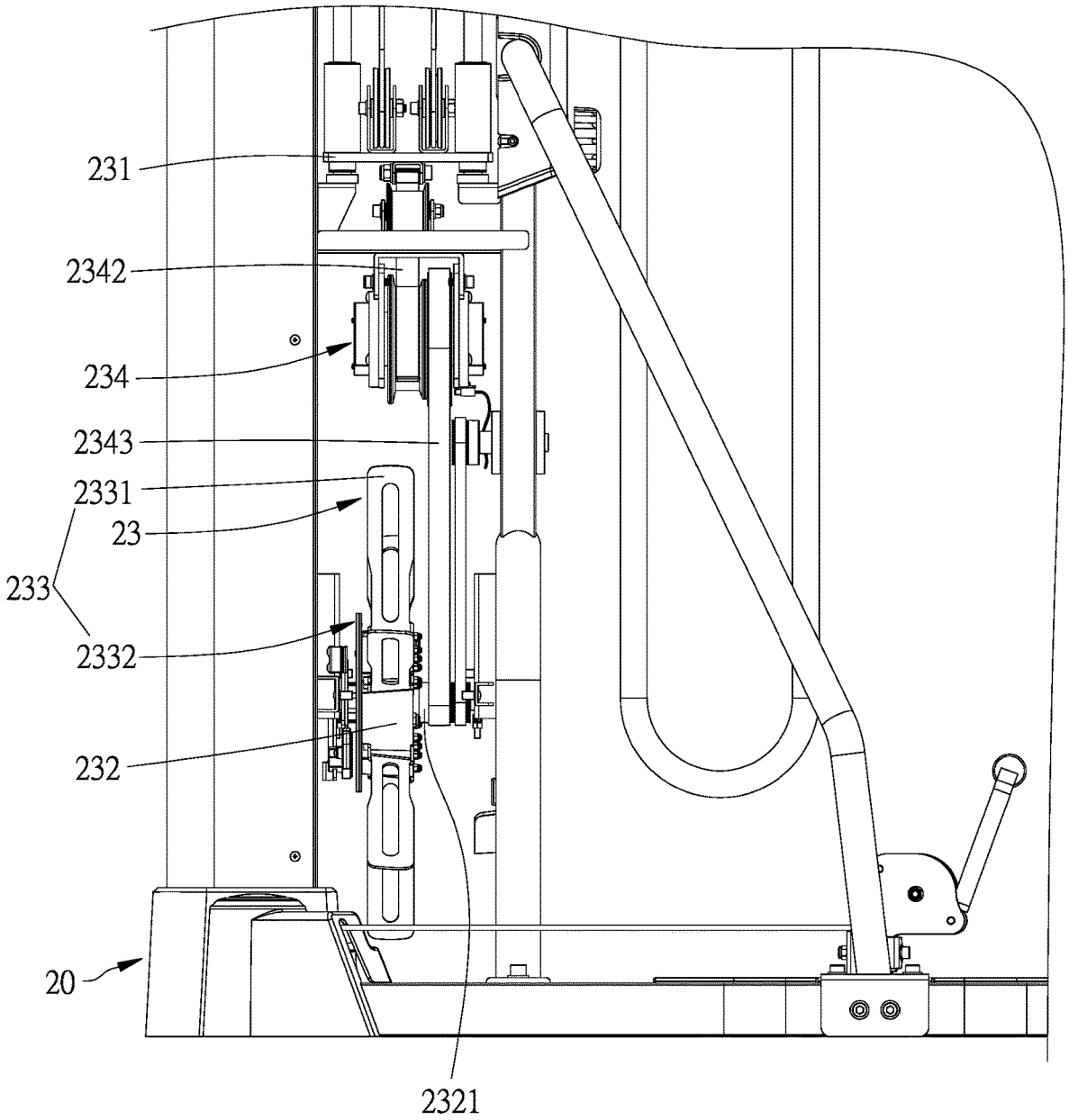
FIG. 9 is a side and partial enlarged view of the load device in accordance with the preferred embodiment of the present invention.
Figure 10:
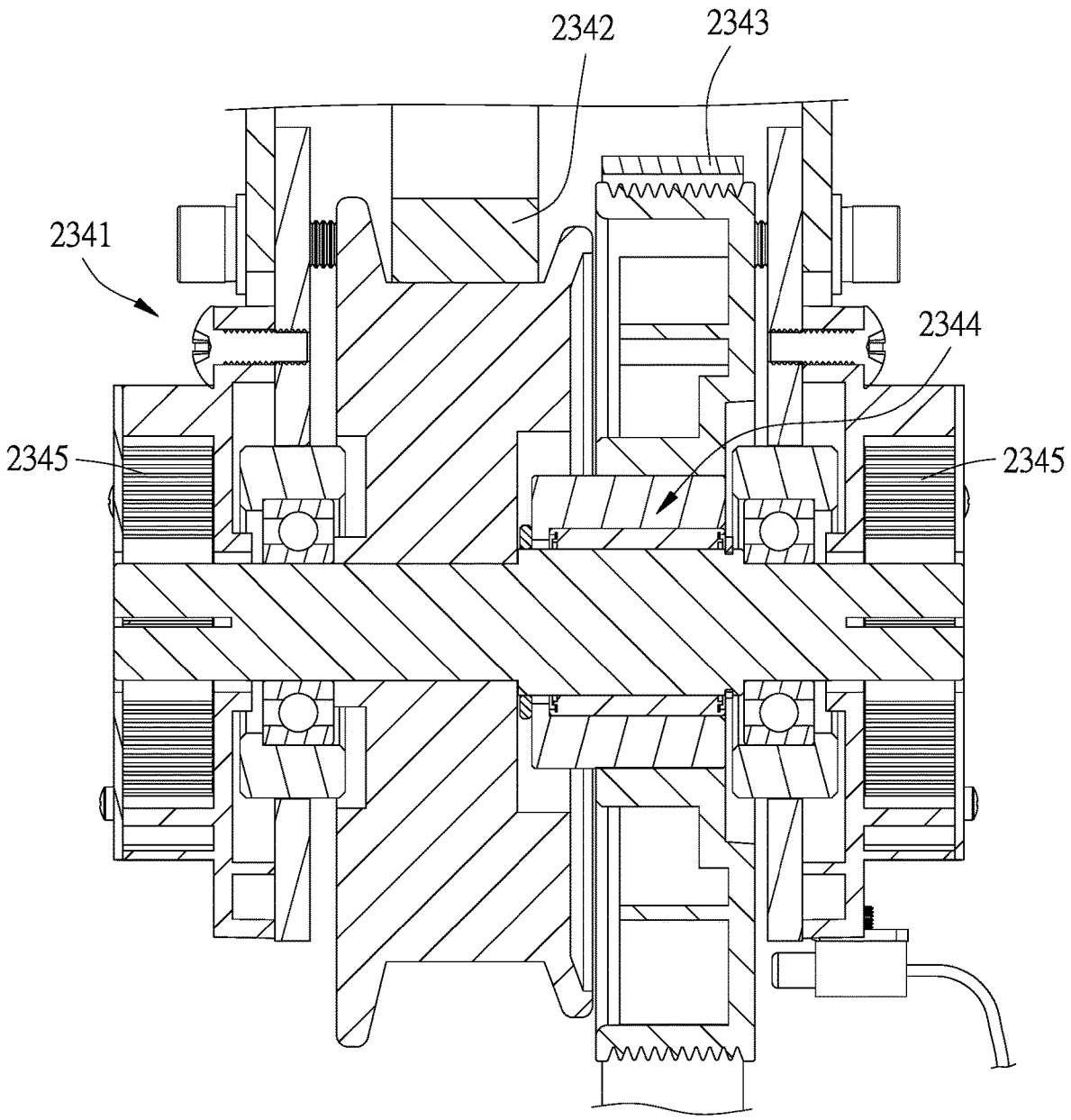
FIG. 10 is a sectional view of the driven wheel of the load device in accordance with the preferred embodiment of the present invention.

Referring to FIG. 9, in this embodiment, the load device (23) further includes a wheel body (232) and a resistance unit (233). The wheel body (232) is rotatably mounted to the coupling seat (20). The resistance unit (233) includes a plurality of blades (2331) annually disposed on the wheel body (232) and a reluctance unit (2332) to provide wind resistance and reluctance, but the implementation is not limited to both, it may be either one of them, or it may be other kinds of resistance units (such as, weight load). In detail, in this embodiment, the displacement seat (231) can drive the wheel body (232) through a belt transmission mechanism (234). The belt transmission mechanism (234) may include a driven wheel (2341). The driven wheel (2341) is wound with a pull belt (2342) and a linking belt (2343). The pull belt (2342) is connected to the displacement seat (231). The linking belt (2343) is wound around a wheel axle (2321) of the wheel body (232), which can drive the wheel body (232). Referring to FIG. 10, preferably, a one-way bearing (2344) is provided between the driven pulley (2341) and the linking belt (2343), having the function of one-way rotation and reverse idling, and cooperates with a spiral spring (2345) (or other kinds of elastic members) to provide a return elastic force.

Figure 11:
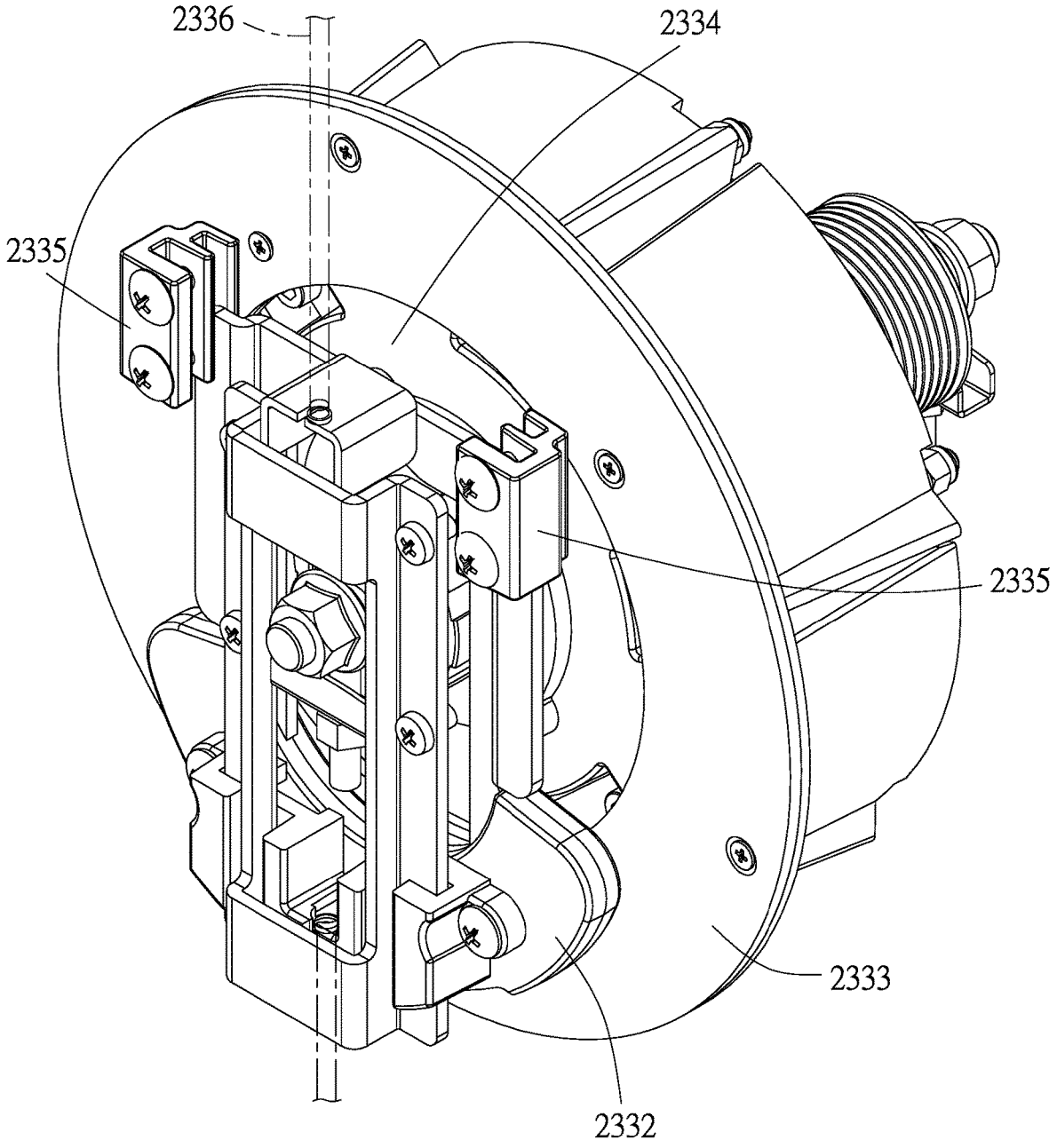
FIG. 11 is a perspective view of the reluctance unit in accordance with the preferred embodiment of the present invention.
Figure 12:
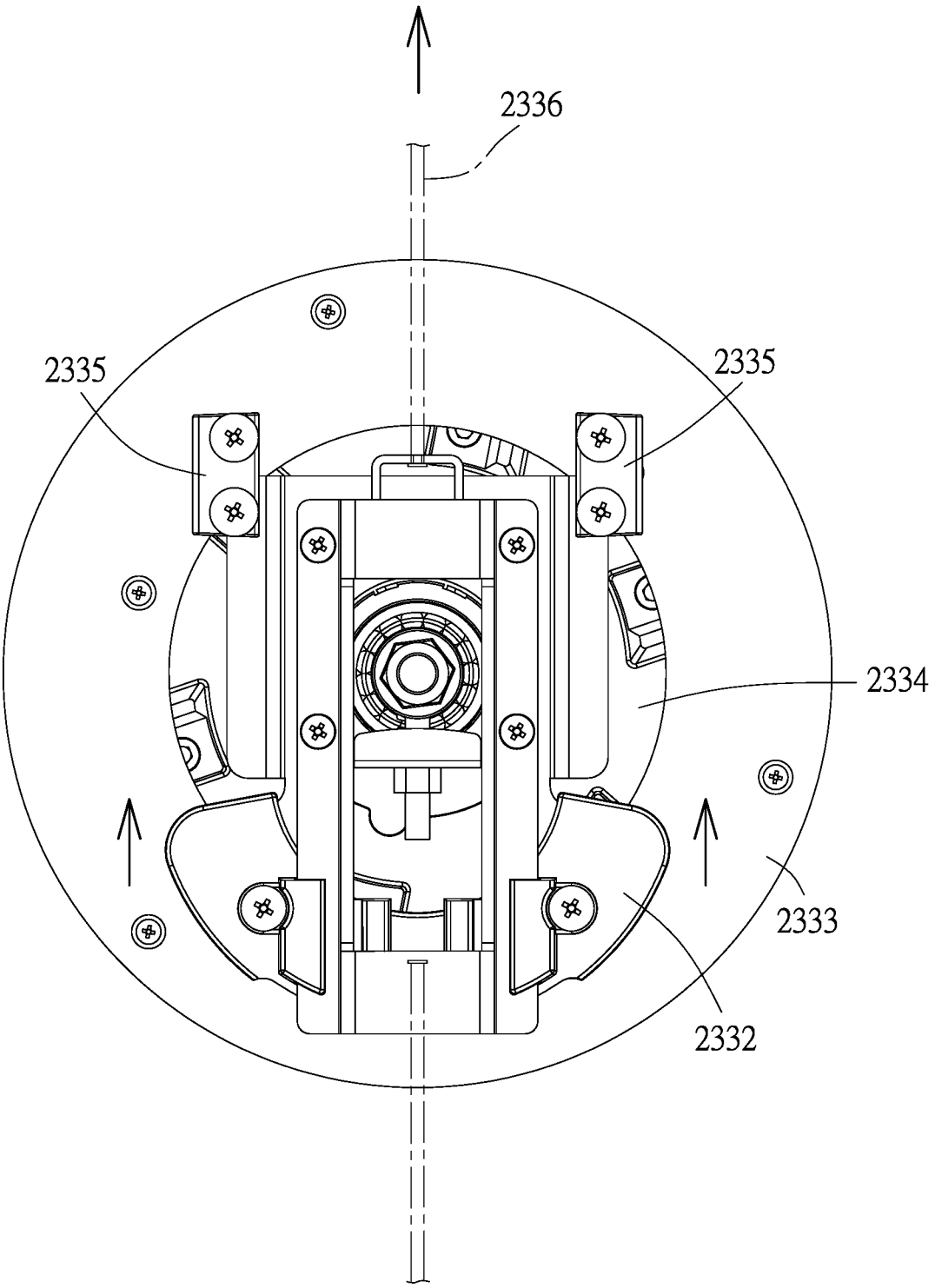
FIG. 12 is a first planar view of the reluctance unit in accordance with the preferred embodiment of the present invention.
Figure 13:
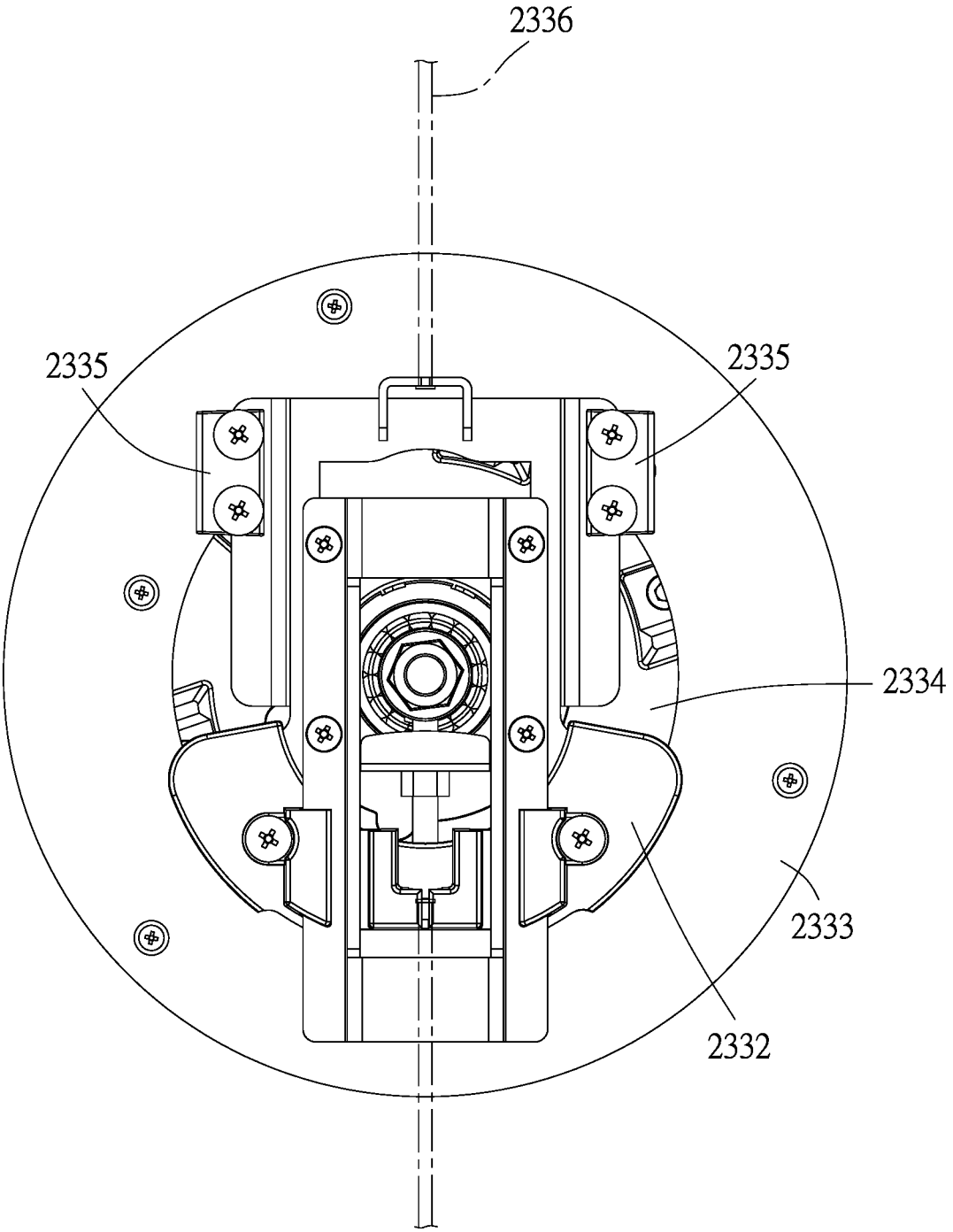
FIG. 13 is a second planar view of the reluctance unit in accordance with the preferred embodiment of the present invention.

Referring to FIG. 11 and FIG. 12, the reluctance unit (2332) is further described in detail. The reluctance unit (2332) is movably mounted on a magnetism shielding member (2333). For example, the magnetism shielding member (2333) may have an annular shape with an opening (2334). The magnetism shielding member (2333) is provided with a pair of slide seats (2335) at two sides of the opening (2334). The reluctance unit (2332) is slidably disposed between the pair of slide seats (2335). The reluctance unit (2332) is displaceable relative to the magnetism shielding member (2333) by an adjusting pull rope (2336). Referring to FIG. 12 and FIG. 13, when the adjusting pull rope (2336) pulls the reluctance unit (2332) to move relative to the magnetism shielding member (2333) to the opening (2334), the reluctance is increased, on the contrary, the reluctance is decreased. Referring to FIG. 13 in conjunction with and FIG. 1, the adjusting pull rope (2336) may be connected with a knob (2337) to form a resistance adjustment module (2338) for the user to adjust the reluctance value of the reluctance unit (2332).

Figure 14:
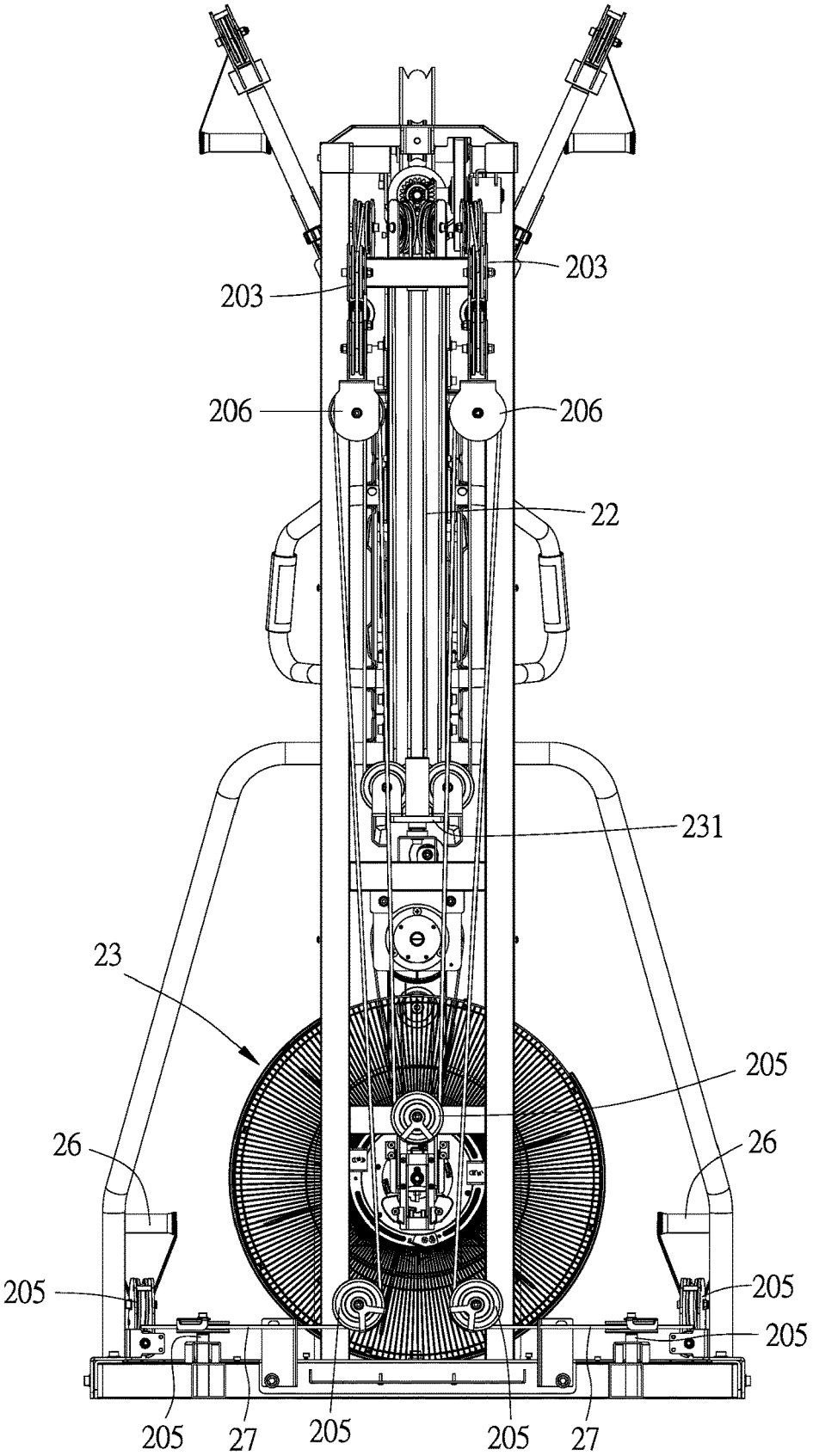
FIG. 14 is a rear view in accordance with the preferred embodiment of the present invention without the outer housing, wherein the ancillary exercise device is completely installed.

Referring to FIG. 14, it is preferable that two of the first guiding winding members (203) are movable. The bottom of the coupling seat (20) is provided with a plurality of second guiding winding members (205) and two linking winding members (206). The two linking winding members (206) are connected to the two movable first guide winding members (203). The main exercise device (2) further includes a pair of second traction handles (26) and a second pull rope (27). One end of the second pull rope (27) is connected to one of the pair of second traction handles (26), and then the second pull rope (27) is sequentially wound around the second guide winding member (205), one of the linking winding members (206), the second guide winding member (205), and the other of the linking winding member (206) and the second guide winding member (205), and the other end of the second pull rope (27) is connected to the other of the pair of second traction handles (26). Thereby, when the second traction handles (26) are pulled, the second pull rope (27) pulls the linking winding members (206) to drive the two movable first guide winding members (203). The displacement seat (231) is linked by the first pull rope (22) to generate a load so that the first traction handles (21) and the second traction handles (26) can share the same load device (23). As to the mechanism that the first pull rope (22) drives the displacement seat (231) to generate a load, please refer to the paragraphs corresponding to FIG. 8 to FIG. 10. For the sake of brevity, the description will not be repeated here.

Figure 15:
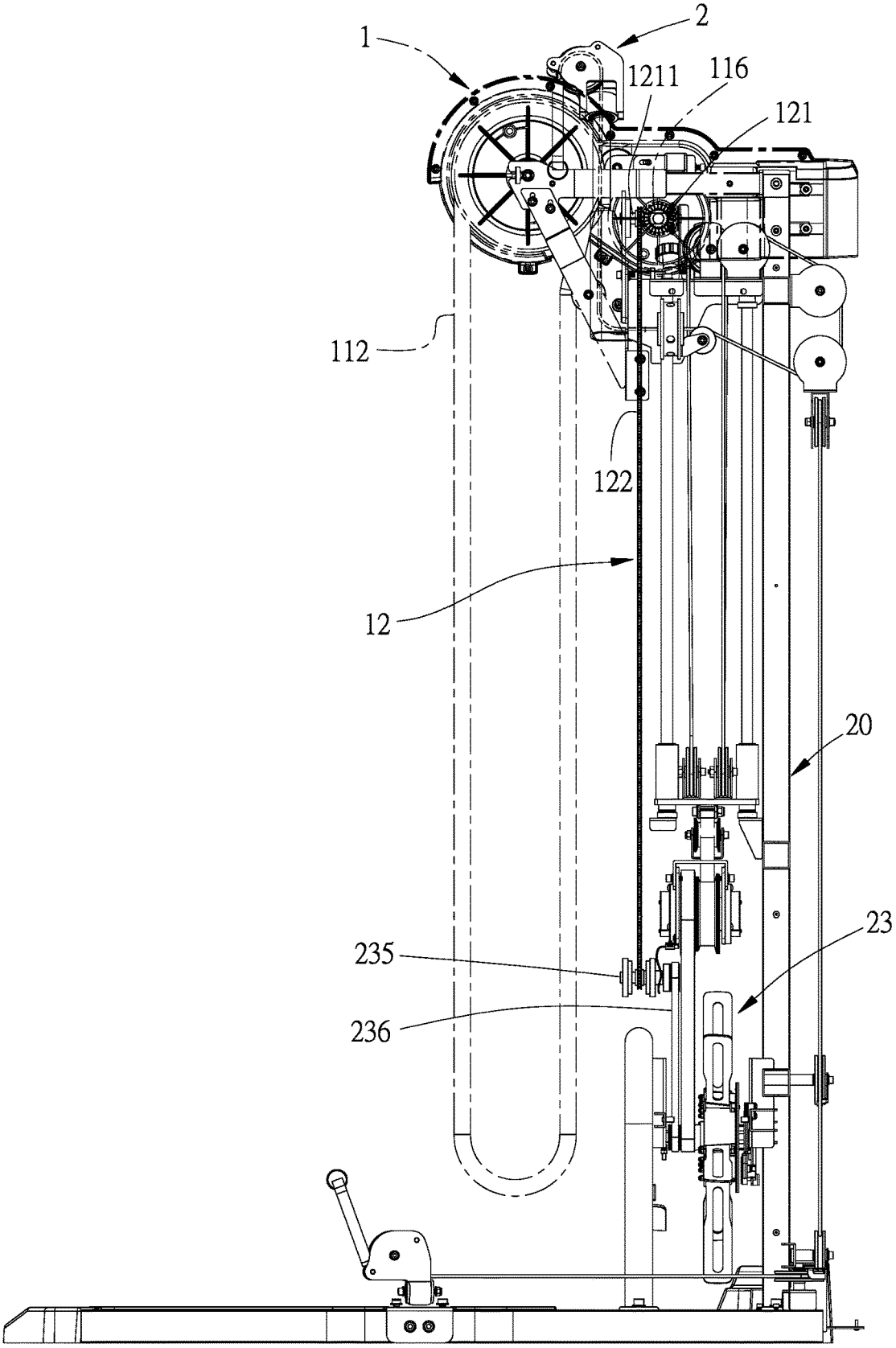
FIG. 15 is a side view in accordance with the preferred embodiment of the present invention without the outer housing, wherein the ancillary exercise device is completely installed.
Figure 16:
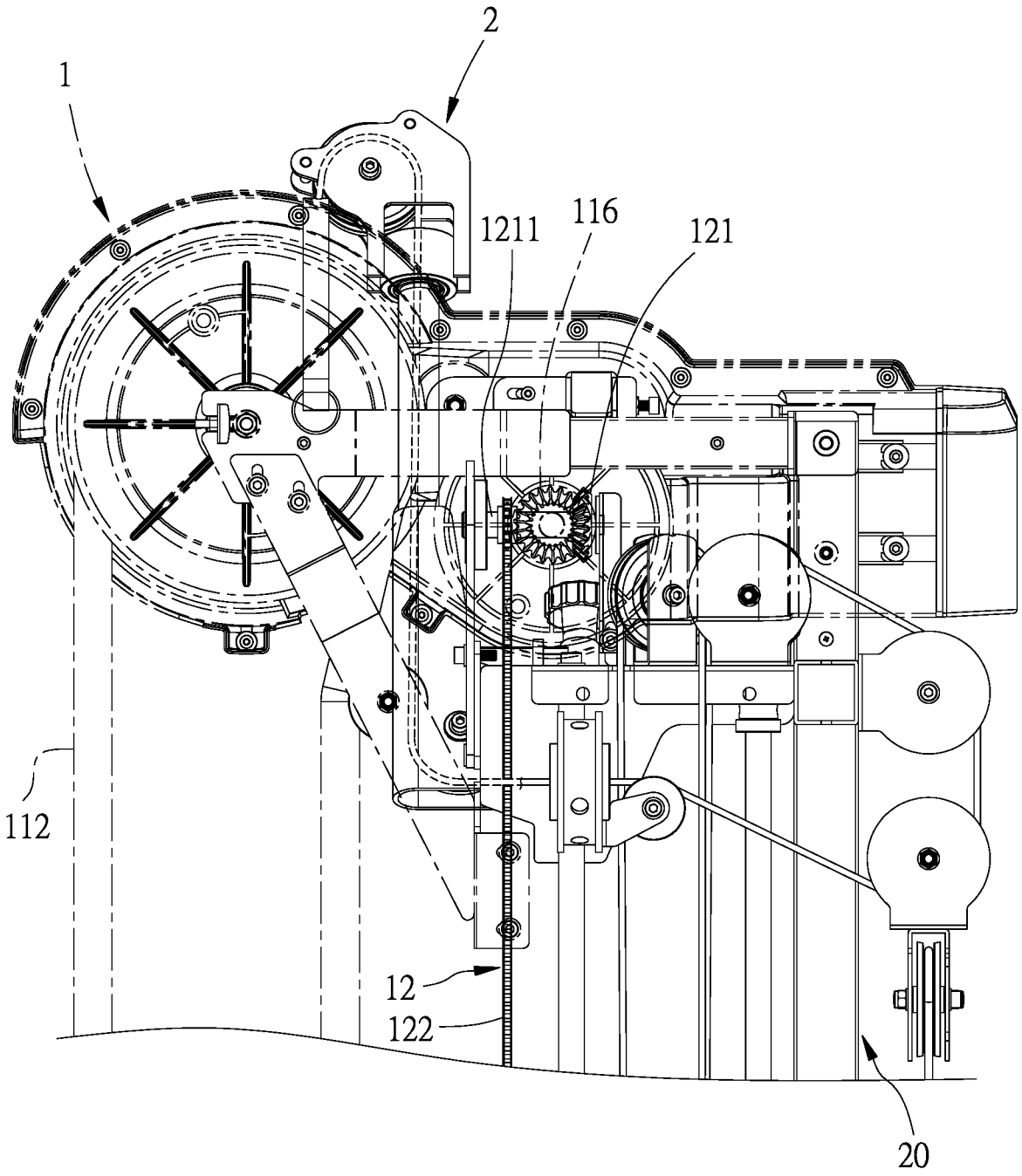
FIG. 16 is a partial enlarged view of FIG. 15.

Referring to FIG. 15 and FIG. 16, the transmission mechanism (12) of the ancillary exercise device (1) includes at least one first transmission gear (121) and a transmission assembly (122). The first transmission gear (121) is pivotally connected to the coupling seat (20). The transmission assembly (122) connects the first transmission gear (121) and the load device (23). Specifically, the first transmission gear (121) has a rotating shaft (1211). The rotating shaft (1211) is provided with a toothed disk (1212) thereon. The transmission assembly (122) is a transmission chain. The load device (23) further comprises a driven shaft (235) pivoted to the coupling seat (20). The transmission assembly (122) connects the driven shaft (235) and the toothed disk (1212). The wheel body (232) is driven by the driven shaft (235) through the driven belt (236).

Figure 17:
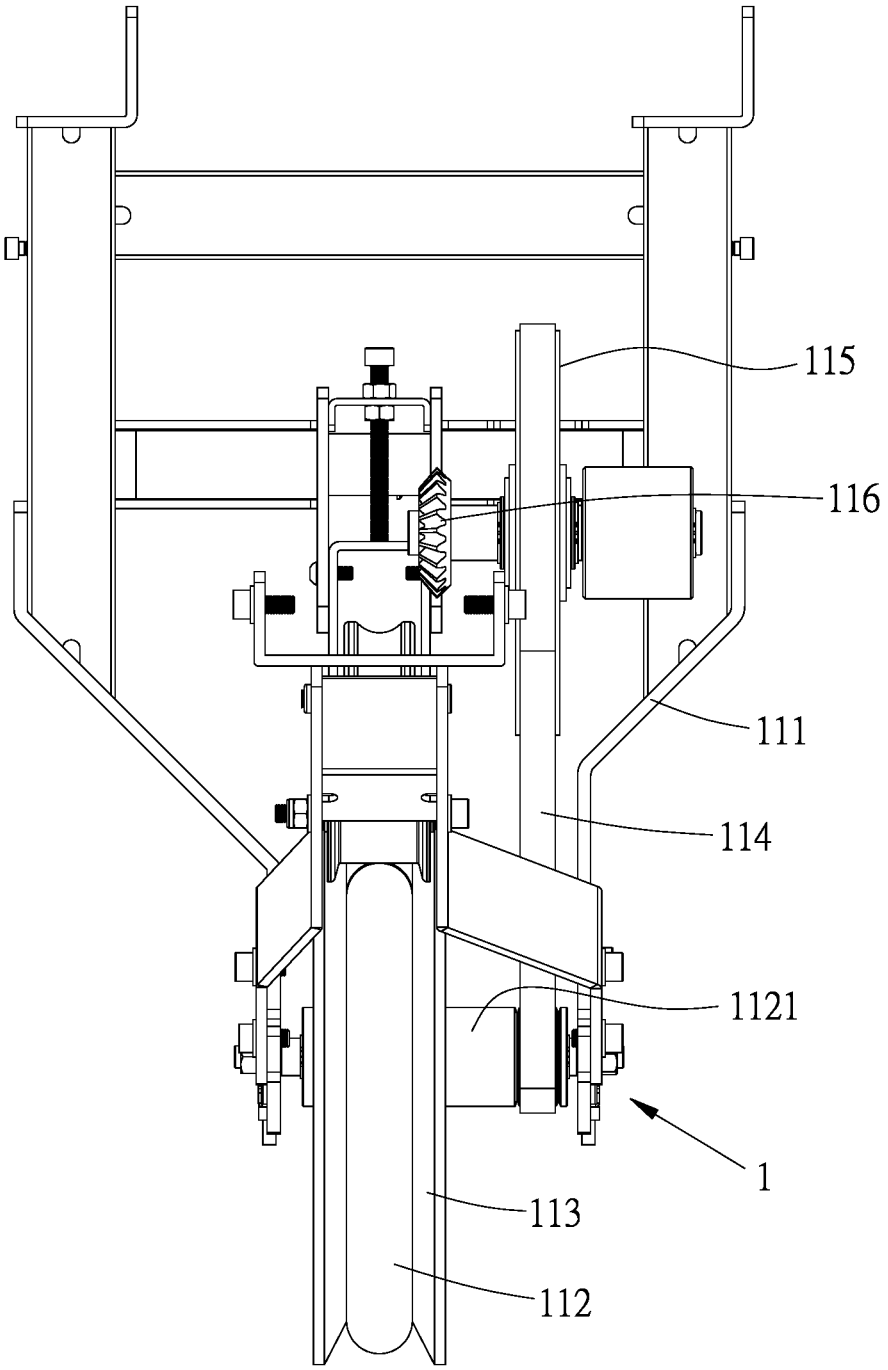
FIG. 17 is a planar view of the operating mechanism of the ancillary exercise device in accordance with the preferred embodiment of the present invention.

Referring to FIG. 17 in conjunction with FIG. 16, the operating mechanism (11) of the ancillary exercise device (1) includes a mounting seat (111), a climbing rope (112), a first driven wheel (113), a transmission belt (114), a second driven wheel (115), and a second transmission gear (116). The mounting seat (111) is detachably mounted to the coupling seat (20) by means of engaging, locking or the like. Both the first driven wheel (113) and the second driven wheel (115) are pivotally connected to the mounting seat (111). The first driven wheel (113) is pivoted by another one-way bearing (1131), having the function of one-way rotation and reverse idle. The climbing rope (112) is wound around the first driven wheel (113). The transmission belt (114) is wound around the first driven wheel (113) and the second driven wheel (115). The second transmission gear (116) is connected to the second driven wheel (115). The second transmission gear (116) is meshed with the first transmission gear (121). Please refer to FIG. 17 and FIG. 16. When the climbing rope (112) is pulled, the first driven wheel (113), the second driven wheel (115), the second transmission gear (116) and the first transmission gear (121) are driven. Referring to FIG. 15, the load device (23) may be driven by the transmission assembly (122) such that the main exercise device (2) and the ancillary exercise device (1) may share the same load device (23).

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An expandable exercise system, used for mounting a first part of an ancillary exercise device, the ancillary exercise device being a rope climbing exercise device, and the expandable exercise system comprising:

a main exercise device, including a coupling seat, and being a traction exercise device; and a second part of the ancillary exercise device, the second part of the ancillary exercise device being pre-mounted to the coupling seat and detachably connected with the first part of the ancillary exercise device to thereby form the ancillary exercise device, and the second part of the ancillary exercise device being a transmission mechanism.

2. The expandable exercise system as claimed in claim 1, wherein the main exercise device includes a pair of first traction handles, a first pull rope, and a load device, the first pull rope is connected with the pair of first traction handles and the load device, the load device includes a wheel body and a resistance unit, the wheel body is rotatably mounted to the coupling seat, and the resistance unit includes a plurality of blades annularly disposed about the wheel body and a reluctance unit for providing wind resistance and reluctance.

3. The expandable exercise system as claimed in claim 2, wherein the load device further includes a resistance adjustment module for adjusting a reluctance value of the reluctance unit.

4. The expandable exercise system as claimed in claim 2, wherein the main exercise device further includes a pair of handle seats and a pair of angle adjustment members, the pair of first traction handles are mounted to the pair of handle seats respectively, the pair of handle seats are movably connected to the coupling seat, and the pair of angle adjustment members fix the pair of handle seats relative to the coupling seat.

5. An expandable exercise system, comprising:

a main exercise device including a coupling seat and a load device; and an ancillary exercise device including two parts, one of the two parts being a transmission mechanism, the transmission mechanism being mounted to the coupling seat and connected with the load device, the other of the two parts being an operating mechanism detachably connected to the transmission mechanism, the main exercise device and the ancillary exercise device thereby sharing the same load device.

6. The expandable exercise system as claimed in claim 5, wherein the load device includes a wheel body, a resistance unit and a resistance adjustment module, the wheel body is rotatably mounted to the coupling seat, the resistance unit includes a plurality of blades annularly disposed about the wheel body and a reluctance unit for providing wind resistance and reluctance, and the resistance adjustment module adjusts a reluctance value of the reluctance unit.

7. The expandable exercise system as claimed in claim 5, wherein the main exercise device is a traction exercise device, the traction exercise device includes a pair of first traction handles mounted to the coupling seat and a first pull rope, the first pull rope is connected with the pair of first traction handles and the load device, the pair of first traction handles thereby drives the load device through the first pull rope; and the ancillary exercise device is a rope climbing exercise device.

8. The expandable exercise system as claimed in claim 7, wherein the traction exercise device further includes a pair of handle seats and a pair of angle adjustment members, the pair of first traction handles are mounted to the pair of handle seats respectively, the pair of handle seats are movably connected to the coupling seat, and the pair of angle adjustment members fix the pair of handle seats relative to the coupling seat.

9. The expandable exercise system as claimed in claim 7, wherein the transmission mechanism of the rope climbing exercise device includes a first transmission gear and a transmission assembly, the first transmission gear is pivotally connected to the coupling seat, the transmission assembly connects the first transmission gear and the load device; the operating mechanism of the rope climbing exercise device includes a mounting seat, a climbing rope, a first driven wheel, a transmission belt, a second driven wheel and a second transmission gear, the mounting seat is detachably mounted to the coupling seat, the climbing rope is wound around the first driven wheel, the first driven wheel and the second driven wheel are pivotally connected to the mounting seat, the transmission belt is wound around the first driven wheel and the second driven wheel, the second transmission gear is connected to the second driven wheel, and the second transmission gear is meshed with the first transmission gear.

* * * * *